United States Patent [19]

Roller et al.

[11] Patent Number: 4,942,289

[45] Date of Patent: Jul. 17, 1990

[54] ELECTRIC HEATING ELEMENT WITH PTC COMPONENT

[75] Inventors: Hanno Roller, Kandel; Roland Starck, Rülzheim, both of Fed. Rep. of Germany

[73] Assignee: Fritz Eichenauer GmbH & Co. KG, Kandel, Fed. Rep. of Germany

[21] Appl. No.: 346,702

[22] Filed: May 3, 1989

[30] Foreign Application Priority Data

May 5, 1988 [DE] Fed. Rep. of Germany ..... 3815306

[51] Int. Cl.[5] ..... H05B 3/10

[52] U.S. Cl. ..... 219/504; 219/544

[58] Field of Search ..... 219/504, 505, 530, 540, 219/541, 544

[56] References Cited

U.S. PATENT DOCUMENTS 4,331,861 5/1982 Meixner ..... 219/541

4,431,983 2/1984 Rodriguez ..... 219/541

4,635,026 1/1987 Takeuchi ..... 219/541

*Primary Examiner*—Roy N. Envall, Jr.

*Attorney, Agent, or Firm*—Antonelli, Terry, Stout & Kraus

[57] ABSTRACT

An electric heating element is proposed, which has a contact unit formed from at least one PTC component and contact plates resting on either side thereof and a casing, whereby for ensuring a good contact pressure in the end product in the unpressed state of the heating element the contact plates (12, 13) are curved and rest with their convex side on the PTC components (14), the casing (2) is made from dimensionally stable light metal and in the unpressed state has an inner wall (17, 18) with a finite radius of curvature (r1) facing in convex manner the contact arrangement (12, 13, 14) and which is larger than the radius of curvature (r2) of contact plates (12, 13).

11 Claims, 2 Drawing Sheets

ELECTRIC HEATING ELEMENT WITH PTC COMPONENT

Figure 1:
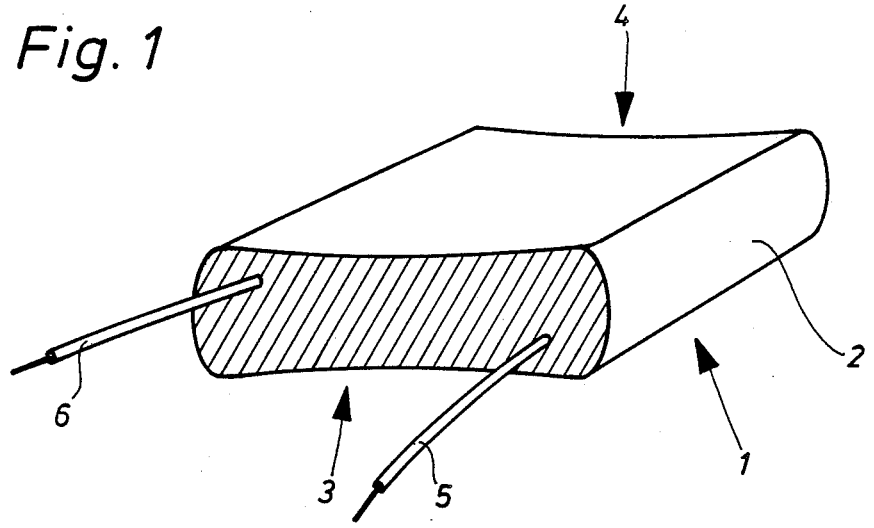

The invention relates to an electric heating element with a contact unit formed from at least one positive temperature coefficient ("PTC") component and contact plates resting on either side thereof, as well as with a casing.

Such a heating element is described in German utility model 78 38 558. In the case of said heating element, flat PTC components are placed between two contact plates, covered with a thin foil, preferably of mica, introduced into a tubular shell, and the free edges initially formed on either side thereof are pressed so that, in section, a bell-shaped contour is obtained. The Brinell hardness for the tubular materials used therein and other standard cases is typically 22 to 38.

It is disadvantageous in this heating element that with increasing operating time the coupling out of heat of the PTC component decreases and therefore the heating element drops into a lower working range (temperature range) and then the power is no longer sufficient, so that the desired heating process can no longer be realized. The reason for this is the negative change to the pressing force on the PTC component, resulting from the nature of the aluminium material, which becomes soft under heat treatment and no longer has any spring characteristics.

German patent 29 48 592 describes an electric resistance heating element with at least one PTC component placed between two contact plates. This contact unit is inserted in a shell or sleeve of electrically insulating, thermally conductive, elastomeric material, so that there is a vertical pressure through the sleeve in the plane to the contact plates resulting from the inherent elasticity of the sleeve.

This arrangement admittedly provided a very good coupling out of heat level for the then prior art and ensures an economically appropriate use in various electrical appliances. However, further developments of PTC components with higher electrical and, in particular, specific power levels require further developments for the improved coupling out of the higher heat output made available through the PTC components and the effective supply thereof. Only as a result of an optimum coupling out of the power or output supplied, can the PTC component be operated in its characteristic working and power curve. Therefore the embodiments of a self-regulating heating element described in DE-AS 2 641 894 are no longer relevant for the presently produced PTC components. In the heating element described therein, the resistance core is made from a ceramic PTC material located centrally within a casing of an electrically insulating, vulcanized plastic with which was admixed an electrically insulating and thermally conductive metal compound. The inner area between the PTC component and the sleeve is filled with a vulcanizing plastic, with which is also admixed an electrically insulating and thermally conductive metal compound, preferably magnesium oxide.

Due to the inadequate possibility of dissipating heat from the PTC component, there is a relative coupling out of the thermal energy from the PTC component. The energy supplied here is only inadequately supplied to the medium to be heated due to the poor coupling out efficiency.

Further heat exchanging contact systems within sleeves are described in DE-OS 26 14 433, in which metal springs engage on the inner wall of the preshaped, multilayer casing and consequently a vertical pressure takes place with respect to the plane of the contact faces on the PTC components.

All these constructions suffer from the disadvantage of unfavourable coupling out of the electrical energy supplied at the medium to be heated. The known constructions for the coupling out of the energy supplied for the PTC components produced according to the then state of the art, specific power levels of approximately 8 W/cm$^2$ are possible.

The goal of the invention is to provide an electric heating element with a positive electric resistance supplying a multiple (3 to 4 times) of the hitherto possible power level and therefore permitting wider applications.

According to the invention this goal is achieved in the case of an electric heating element with a PTC component of the aforementioned type, in that the contact plates and casing have a Brinnell hardness of 80 to 100, that in the unpressed state of the heating element the contact plates are curved and rest with their convex side on the PTC elements, that the casing is made from dimensionally stable light metal and in the unpressed state has an inner wall with a finite radius of curvature convexly facing the contact arrangement and which is larger than the radius of curvature of the contact plates.

According to a preferred embodiment the PTC components are placed between two circular segmentally, outwardly bent connecting plates, which are larger than the contact faces of the PTC components and fixed in a mask of electrically insulating material, such as a mica plate with recesses or a dimensionally stable plate of crushed mica bound with binders (trademark Multimica). Recesses are provided on the connecting plates for connection of connecting wires. This contact arrangement, with PTC components fixed in the mask and in section arcuately curved contact plates, is inserted in a cross-sectionally elliptical sleeve of polyimide film (Kapton) and is then inserted in friction-free manner, i.e. without jamming, into the light metal casing formed from a rectangular extrudate, followed by mechanical pressing.

The longitudinal sides of the casing formed by the rectangular extrudate are curved convexly inwards, said curvature having a larger radius r1 than the radius r2 of the contact plates. During the subsequent mechanical pressing a spring tension is built up occurring as a pressing force on the contact faces of the PTC components and which does not decrease even on heating the heating element and after prolonged use. No reduction in the pressing force compared with known heating elements was revealed during long-term tests lasting more than 1500 operating hours. The narrow sides of the sleeve of generally rectangular, extruded aluminum metal are—regarded in one section—in there middle region larger than their connection regions to upper and lower walls. The narrow sides are especially convex as well to their outer sides as to their inner sides. By this design after mechanical deformation (pressing) of upper and lower aluminum metal faces directed against one another with the different radii, an abutment is provided, which is large enough to ensure a permanent compressive stressing of the PTC component. The Brinell hardness of the material used is between 80 and 100. The material used for the contact plates and the aluminum extrudate is preferably Al Mg Sil alloy (composition Mg 0.6–1.2; Si 0.75–1.3; Mn 0.4–1.0; Cr 0–0.3, remainder Al). Particular preference is given to Al Mg Sil F 31 with the material no. 32315.71–32318.72. This aluminum material in the case of the arrangement facing the outside of the contact plate and the inside of the sleeve and with the barrel-shaped construction of the narrow sides of the rectangular sleeve ensures a progressive and permanent spring tension on the PTC components located between the contact plates, so that a 3 to 4 times higher power, i.e. 35 to 40 $W/cm^2$ is obtained compared with the known and previously described types (approximately 8 $W/cm^2$), which is constant over long periods. Unlike in the case of conventional heating elements, the efficiency of the PTC components is a function of the quality of the heat dissipation. Thus, the resistance and therefore the capacity of a PTC component is determined by its internal temperature, which as such cannot easily be measured. According to the DIN standard, the temperature on the surface of the contact arrangement, i.e. the back of the contact element, is measured. In the case of poor coupling out of heat and with stationary power removal, much lower temperatures are measured than with a good or optimum coupling out of heat (in both cases the temperature in the interior of the PTC component necessarily being the same). With a good coupling out of heat, higher temperatures are obtained according to the DIN standard and a superproportionally higher power is obtained. Since, compared with the previously known PTC components, those with a 3 to 4 times higher power are made available, it is also necessary to couple out the same, which was not the case with the previously described heating elements. The latter are unable to use this higher power. This is on the one hand due to the reduction in the pressure for the aforementioned reasons, but on the other to the aging of the elastic plastic sleeves and their instability, particularly under the sought, still higher temperatures on the contact arrangement.

A heating element produced in this way, which is mainly used for heating fluids, such as water, can be manufactured from an extrudate open on both sides, the two open edges then being cast in watertight manner with resin, or can be formed by a sleeve with a base provided at one side.

Further advantages and features of the invention can be gathered from the claims and the following description of a non-limitative embodiment with reference to the drawings, wherein show:

FIG. 1 The inventive heating element in a perspective view.

Figure 2:
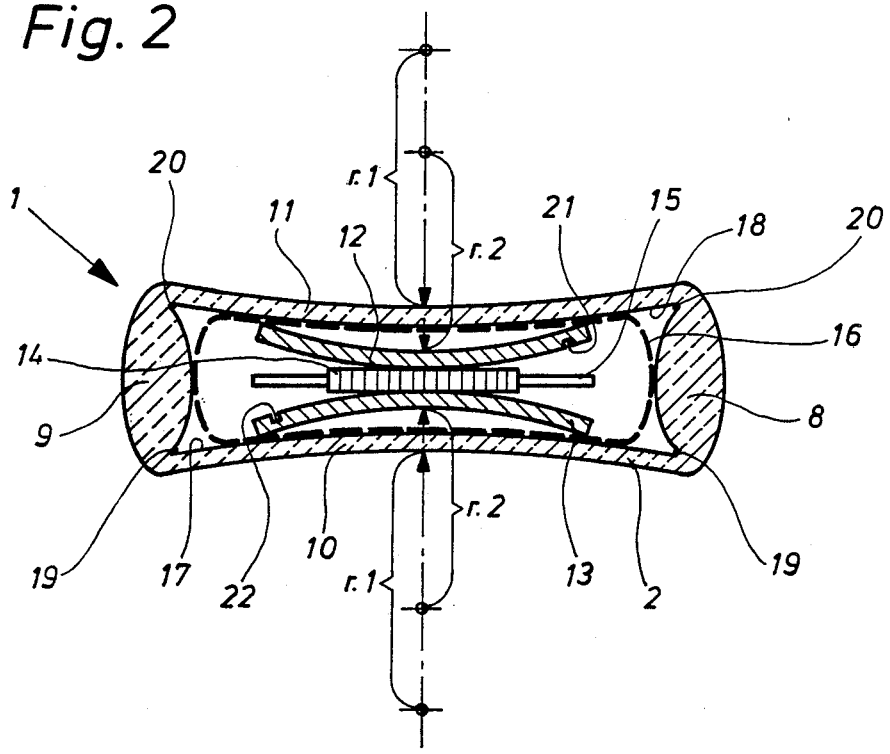

FIG. 2 A cross-section through a unit for the further processing to a heating element, prior to pressing.

Figure 3:
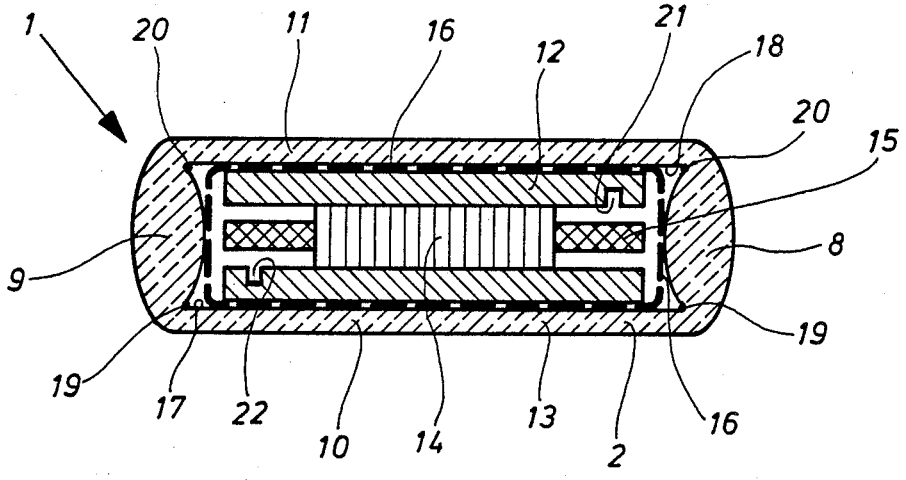

FIG. 3 A cross-section corresponding to FIG. 2 after pressing to the finished heating element.

Figure 4:
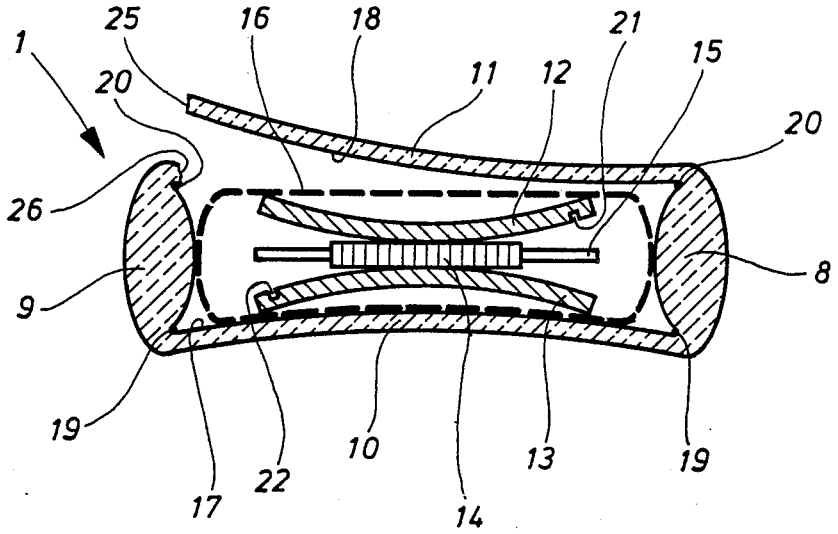

FIG. 4 A section corresponding to FIG. 3 after cutting open, in the edge region, a pressed element.

The heating element 1 shown perspectively in FIG. 1 has a sleeve 2 made from an extruded aluminium alloy with material no. 32315.71–32318.72, in which the initially open sides 3, 4 are sealed or closed and from which the connections 5, 6 pass out at one side. The grooves 21, 22 shown in the outer longitudinal edge of the contact plates 12, 13 are used for receiving the electrical connections 5, 6 (FIG. 2).

An inventive electric heating element is more particularly produced in that the contact arrangement with contact plates 12, 13 convexly facing the PTC components are inserted in an opening of a light metal casing with convexly inwardly curved inner walls and which exceeds the cross-sectional dimension of the contact arrangement and subsequently pressing takes place of casing 2 and contact plates 12, 13.

FIG. 2 shows a cross-section through a unit 1*a* for further processing to a heating element 1. It has a contact unit A on the PTC resistance element 14, the mask 15 surrounding the same and contact plates 12, 13. The contact unit A is inserted in casing 2, accompanied by the interposing of an insulating envelope 16. The substantially rectangular casing 2 is, in section, barrel-shaped on the narrow sides 8, 9. The two longitudinal sides 10, 11 are inwardly curved with the radius r1, i.e. their convex sides face the contact unit A. The PTC component inserted between both contact plates 12, 13 is placed in a mask 15 of electrically insulating material, such as mica or resin-bonded mica fibers (Multimica) to prevent movement. Contact plates 12, 13 are made from the same material as the casing. The thickness of mask 15 is smaller than that of the PTC component 14. The contact unit with the contact plates 12, 13, the PTC component 14 and the mask 15 is surrounded by an envelope 16 of electrically insulating, thermally stable polyimide film commercially available under the trade name Kapton. The contact unit formed by contact plates 12, 13 with the PTC resistance members 14 located between the same in mask 15 and held together by the electrically insulating material envelope 16 can be relatively easily inserted in aluminum sleeve 2 during manufacture.

Contact plates 12, 13 are bent outwards against the insides 17, 18 of the rectangular aluminum casing 2 of heating element 1 under a radius r2, i.e. directed with their concave side to the adjacent casing wall. Radius r2 is smaller than the radius r1 of the two inwardly curved longitudinal sides 10, 11 of the casing. Following the fitting of the contact unit A provided with the electrically insulating envelope 16 a permanent spring tension is built up through pressing the aluminum casing 2 and deforming the longitudinal sides 10, 11 of casing 2 and contact plates 12, 13 compared with the unstressed, relieved state, through said radii r1 of casing walls 10m 11 and r2 of contact plates 12, 13. Due to the uuse of the relatively hard aluminum alloys for the rectangular sleeve 2 and contact plates 12, 13, this remains constant and therefore ensures an optimum coupling out of the energy supplied via the electrical connections 5 and 6.

The two preferably barrel-shaped narrow sides 8, 9, after deformation, form abutments for the outwardly directed spring tension of the contact plates 12, 13. Long-term tests with the inventive heating element 1 established that as a result of the barrel-shaped narrow sides 8, 9 the vertically upwardly directed and outwardly directed spring tensions can be absorbed much more easily than in the case of all-round, constant cross-sections of the narrow sides 8, 9 of the aluminium casing, so that there is an optimum constancy of the coupling out of heat and the efficiency is consequently maintained for a longer period. The construction of the narrow sides 8, 9, as shown in FIG. 2, is not the only possible construction. The necessary raising of the cross-sectional surface 1 for forming an adequately firm abutment for absorbing the spring tensions can be achieved by other cross-sectional shapes, such as lozenge, circular and similar shapes. Further tests with the heating element 1 have revealed that an optimum, extremely constant, uniform pressing of the narrow sides is ensured if the transitions 19, 20 from longitudinal sides 10, 11 to narrow sides 8, 9 have constrictions in the corners 19, 20.

FIG. 3 shows the inventive heating element in the finished, pressed state. It is clear that during pressing, more particularly the height of the external dimensions in the vicinity of the narrow sides 8, 9 has been reduced and the spherical or barrel-shape of the narrow sides 8, 9 increased. The spherical narrow sides 8, 9 become plastic during pressing against the spring action of contact face 12, 13 and absorb the forces thereof as an abutment after pressing. This can be gathered from FIG. 4. Thus, if the jacket of the inventive heating element is cut through in an edge area at 26, then the corresponding wall 11 springs up in the represented way under the action of the tensioned contact face 12, 13 shown in FIG. 3. The inventive arrangement consequently does not retain its cross-sectional shape on cutting in edge region 26. This shows that in the finished, pressed form according to FIG. 3, the contact face can be pressed with considerable force against the PTC component 14, so that the coupling out of power is greatly increased and improved. FIG. 3 also shows that pressing can take place in such a way that the two longitudinal sides 11, 10 are substantially planar, so that further heat dissipation can take place by means of these.

We claim:

1. Electric heating element with a contact unit formed from at least one PTC component and contact plates pressed flat on either side thereof, and pressed within a casing, characterized in that the contact plates and casing have a Brinell hardness of 80 to 100, that in the unpressed state of the heating element the contact plates are curved and rest with their convex side on the PTC component, that the casing is made from dimensionally stable-light metal and in the unpressed state has an inner wall convexly facing the contact arrangement and having a finite radius of curvature, which is larger than the radius of curvature of contact plates.

2. Heating element according to claim 1, characterized in that the contact plates are under elastic tension after pressing.

3. Heating element according to claim 1, characterized in that the casing is an extruded profile casing.

4. Heating element according to claim 3, characterized in that an end closing one side of the casing is constructed in one piece with the residual casing.

5. Heating element according to claim 1, characterized in that at least one of the contact plates and casing are made from AlMgSil.

6. Heating element according to claim 5, characterized in that at least one of the contact plates and casing are made from AlMgSil F31.

7. Heating element according to claim 1, characterized in that the narrow sides of the casing have a convex cross-section.

8. Heating element according to claim 7, characterized in that the narrow sides are spherical in section.

9. Method for producing an electric heating element, in which a contact arrangement of at least one PTC component and contact plates resting on either side thereof is inserted in a casing, characterized in that the contact arrangement with contact plates convexly facing the PTC components is inserted in an opening of the light metal casing with convexly inwardly curved inner walls and which is larger than the cross-sectional dimension of the contact arrangement and subsequently casing and contact plates are pressed.

10. An electric heating element comprising:

a PTC component having a pair of contact plates pressed flat against opposing major surfaces thereof, said contact plates being made of a material having a Brinell hardness of 80 to 100 and, in an unpressed state, being curved with a first radius of curvature and having their respective convex sides resting against said major surfaces of said PTC component; and a substantially rectangular casing surrounding said PTC component having respective opposed, longitudinally extending sides pressed flat against said pair of contact plates, said casing being made of a dimensionally stable light metal having a Brinell hardness of 80 to 100, and said opposed, longitudinally extending sides, in an unpressed state, being curved with a second radius of curvature larger than said first radius of curvature and having their respective convex sides resting against said pair of contact plates.

11. An electric heating element according to claim 10, further comprising an insulating envelope surrounding said PTC component and said pair of contact plates within said casing.

* * * * *